United States Patent [19]

Shy

[11] Patent Number: 4,773,491

[45] Date of Patent: Sep. 27, 1988

[54] DRILL HEAD ASSEMBLY

[76] Inventor: Max H. Shy, 101 Salado La., Mauldin, S.C. 29662

[21] Appl. No.: 49,465

[22] Filed: May 14, 1987

[51] Int. Cl.[4] ..... E21B 10/26

[52] U.S. Cl. ..... 175/385; 175/413

[58] Field of Search ..... 175/320, 385, 392, 412, 175/413

[56] References Cited

U.S. PATENT DOCUMENTS

| | | | |
|---|---|---|---|
| 2,101,864 | 12/1937 | McCallum | 175/413 X |
| 2,770,449 | 11/1956 | McCarthy | 175/413 X |
| 2,886,292 | 5/1959 | Petersen | 175/413 |
| 2,990,896 | 7/1961 | Kandle | 175/413 X |
| 4,380,271 | 4/1983 | Baker et al. | 175/413 X |
| 4,632,195 | 12/1986 | Emmerich | 175/320 |

*Primary Examiner*—Stephen J. Novosad
*Assistant Examiner*—William P. Neuder
*Attorney, Agent, or Firm*—Bailey & Hardaway

[57] ABSTRACT

A drill head assembly especially adapted but not limited to horizontal drilling with placement of casing is illustrated as including a drill head body, a wing cutter assembly, and a drive shank all having interlocking connections and assembled by a longitudinal assembly screw.

2 Claims, 3 Drawing Sheets

DRILL HEAD ASSEMBLY

BACKGROUND OF THE INVENTION

Drill head assemblies generally used for horizontal earth and rock boring usually include a drill head body carrying a plurality of spaced bits wherein a drive shank is carried within a transverse groove in a base portion of the drill head body and welded therein. If a casing is to be inserted at the same time the hole is drilled a wing cutter assembly positionable upon the drive shank is utilized. Since the drive shank is welded to the drill head body, such may not be removed for substitution of a different size drive shank in the field. Moreover, the utilization of a wing cutter assembly is made more difficult and awkward because of the necessity of accommodating same to a drive shank which is welded in place and which may not be substituted to accommodate other equipment. A drill head assembly having a recess in a pilot bit for receiving an insert carried by a drill head body providing a connection formed by interlocking surfaces is illustrated in U.S. Pat. No. 2,886,292.

It is an important object of this invention to provide a drill head assembly having a drill head body, a wing cutter assembly and a drive shank all of which are secured together against rotation by insertable connecting means having interlocking surfaces and being axially pulled together by a longitudinal assembly screw having a head accommodated within a cylindrical opening in a forward portion of the drill head body and a threaded end secured to the drive shank.

Another important object of the invention is the provision of a drill head assembly having a drive shank which is removable for substitution of a drive shank of a different size to accommodate other equipment of varying sizes.

Another important object of the invention is the provision of a versatile drill head assembly which may be readily assembled or disassembled utilizing a socket and insertable connections having interlocking surfaces such as flats which readily receive the extensive torque incidental to rock drilling.

Another object of the invention is the provision of a drill head assembly wherein the wing cutter assembly or block can be taken out of its insertable connection relationship and a drive shank having a similar insertable connection means directly inserted into the drill head body. It is thus seen that the parts can be removed through disassembling and various parts locked into place to accommodate different sizes of equipment for drilling different size holes. Thus, various component parts can be replaced or adjusted on the job site.

SUMMARY OF THE INVENTION

It has been found that a drill head assembly may be provided utilizing insertable connection means having interlocking surfaces for respectively joining a wing cutter assembly to a base or rearward portion of a drill head body and in turn a drive shank may be similarly mounted upon the wing cutter on a rearward portion thereof. This entire assemblage may be joined and pulled together by a threaded longitudinal axially disposed assembly screw.

BRIEF DESCRIPTION OF THE DRAWINGS

The construction designed to carry out the invention will be hereinafter described, together with other features thereof.

The invention will be more readily understood from a reading of the following specification and by reference to the accompanying drawings forming a part thereof, wherein an example of the invnetion is shown and wherein:

FIG. 3 is a perspective view which is folded to illustrate the insertable connecting means as well as the longitudinal threaded assembly screw for joining the various components of the drill head assembly.

DESCRIPTION OF A PREFERRED EMBODIMENT

The drawings illustrate a drill head assembly including a drill head body A carrying a plurality of spaced bits. A pilot bit is threadably carried in a forward portion of the drill head body. A wing cutter assembly B is carried by the drill head body rearwardly thereof. An insertable connection means C has interlocking surfaces for mounting the wing cutter assembly in fixed relation on the drill head body. A drive shank D is carried by the wing cutter rearwardly thereof. An insertable connection means E has interlocking surfaces for mounting the drive shank on the wing cutter. A longitudinal assembly screw F is axially disposed within and joins the drill head body, the wing cutter and the drive shank forming a drill head assembly.

Referring more particularly to the drawings, the drill head body A comprises a bit carrying member 10 which includes a forwardly extending portion **10*a* for positioning bits 11 which may be the usual carbide tipped members in a first of the circumferentially spaced bits and enlarged rear drill head body portion 10*b* carries a second circumferentially spaced row of bits 12. The drill head body A further includes a reduced forwardly extending end member 10*c* integral with the intermediate forwardly extending portion 10*a* and the enlarged rear portion 10*b***.

Figure 1:
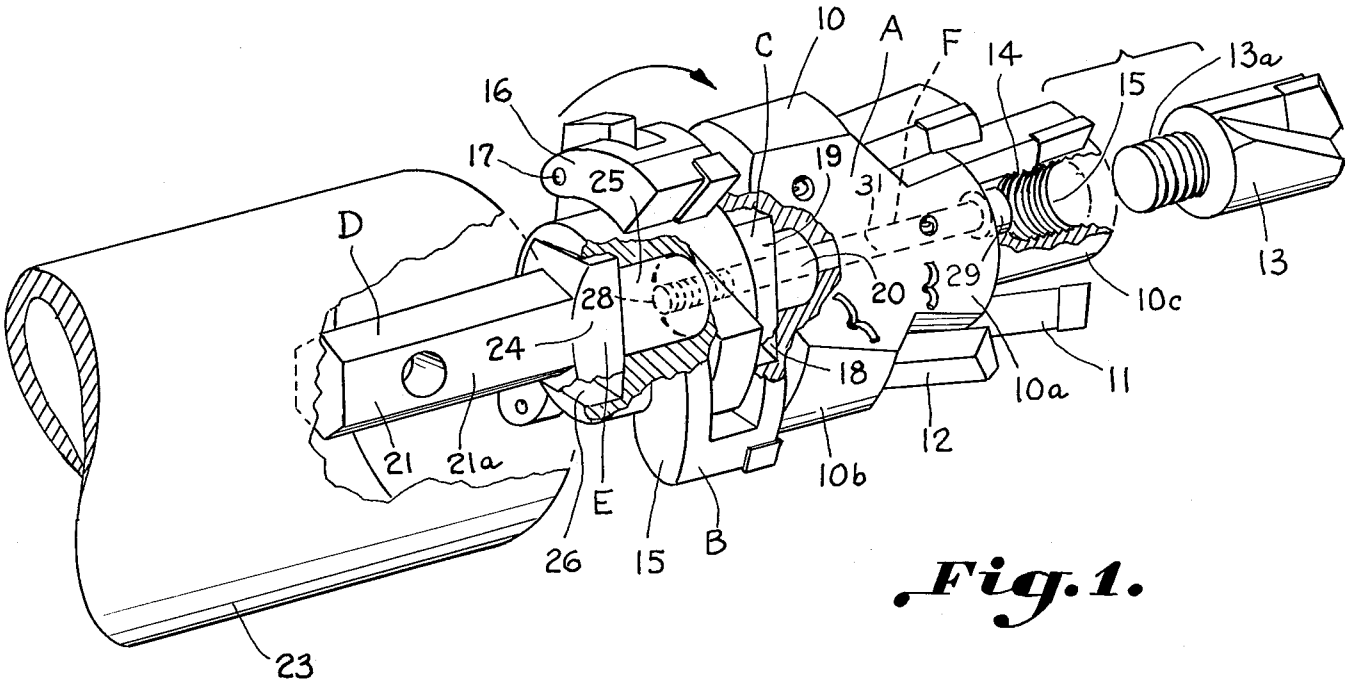
FIG. 1 is a perspective view, with parts broken away, illustrating a drill head assembly constructed in accordance with the present invnetion with casing.
Figure 2:
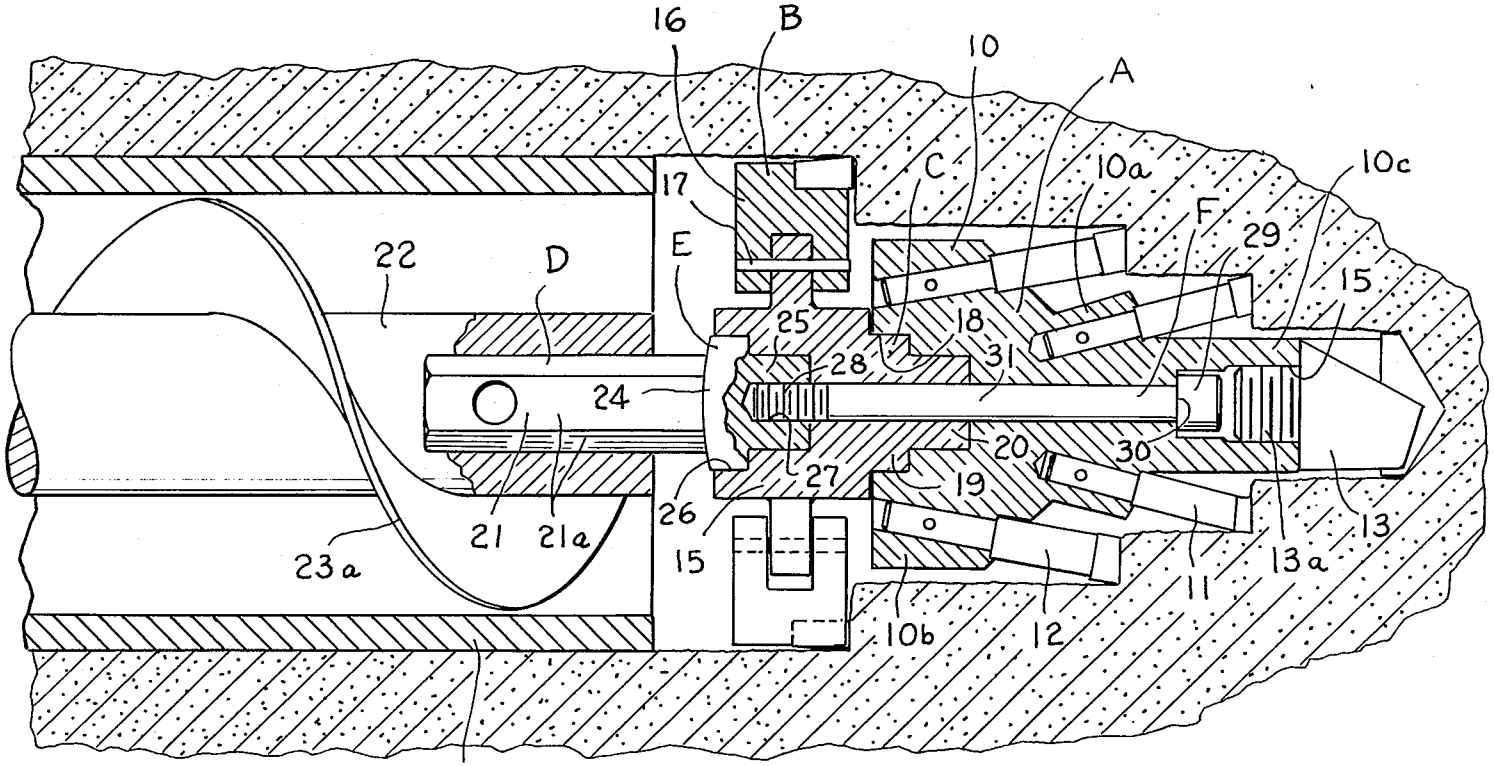
FIG. 2 is a longitudinal sectional elevation of the drill head assembly of FIG. 1 illustrating the interlocking means for joining and permitting disassembly of the components forming the drill head assembly.
Figure 5:
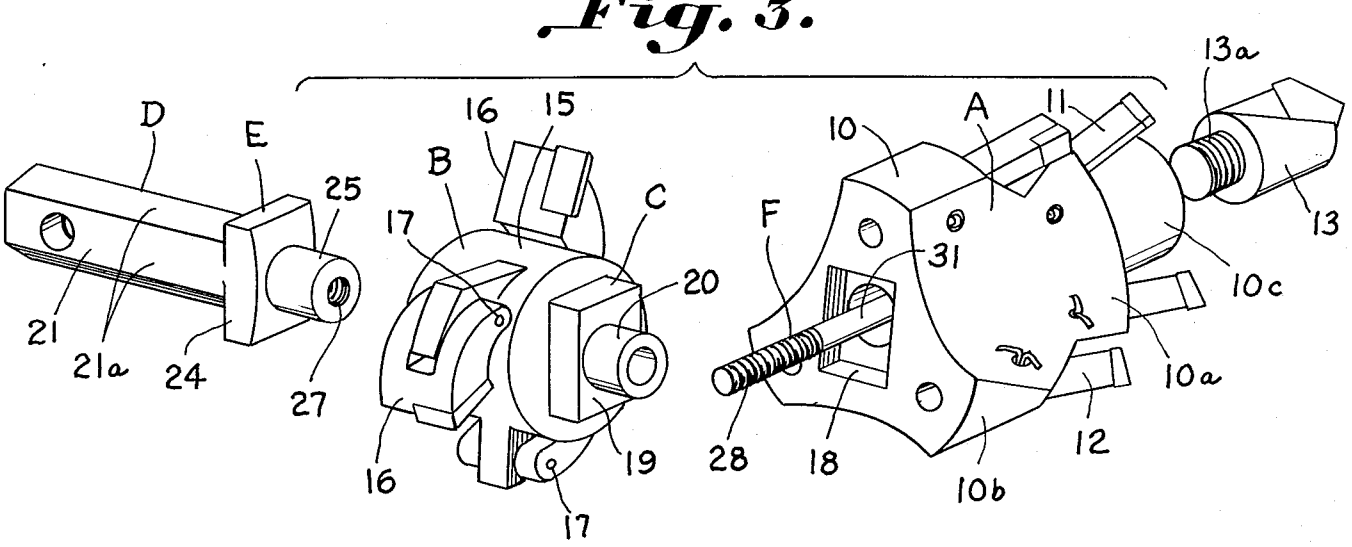

The usual pilot bit 13 is illustrated as having a threaded connector **13*a* threadably received as at 14 within an enlarged circular opening 15 in the forwardly extending body portion 10*c*, FIGS. 1 and 2. The wing cutter assembly B includes the usual fixed body portion 15 having the usual cutter teeth 16 pivoted as at 17 upon the body portion 15**.

An insertable connection means C has interlocking surfaces for mounting the wing cutter assembly in fixed relation on the drill head body A. The insertable connection means C includes a socket 18 carried by the drill head body A and an insertable member 19 integral and projecting forwardly of the wing cutter assembly body 15. A cylindrical portion 20 extends forwardly of the insertable member 19 for receiving an axial fastening means for securing and pulling together the assembly. The socket 18 and insertable member 19 have complimentary side and end surfaces which form suitable interlocking surfaces to withstand the rotary torque incidental to drilling.

A drive shank D is carried by the wing cutter rearwardly thereof and includes a shank portion 21 having flats 21*a* thereon for receiving the usual drive means 22 (FIG. 2) which accommodates the casing 23 with the auger 23*a* during insertion thereof following the drill head assembly during drilling.

The insertable connecting means E includes an abutment 24 carrying flats as well as a cylindrical projection 25 receivable within a socket 26 within the wing cutter assembly B. The forward projection 25 has an internally threaded axial opening 27 for receiving a threaded end 28 of the longitudinal assembly screw F. An enlarged head preferably in the form of an Allen Head 29 of the cap screw F abuts the surface 30 (FIG. 2) within the opening 15 so that turning of the cap screw pulls the parts of the assembly together. An intermediate shank portion 31 is provided between the head 29 and the threaded end 28 of the cap screw.

While the apparatus has been described as being useful in horizontal drilling and especially rock drilling, such as illustrated in FIG. 2, it is to be understood that such apparatus may be useful in all forms of earth drilling as well as vertical drilling and may be utilized with the wing cutter assembly for placement of the casing simultaneously with the drilling, or the wing cutter assembly may be removed as discussed above. The teeth or third set of bits carried by the wing cutter assembly body or housing drill the holes in stages to permit insertion of casing with a minimum amount of friction. Thus, the hole with accommodation for the casing is drilled in a series of three steps. The wing cutter teeth or bits are collapsible when the assembly is turned in a direction opposite the arrow in FIG. 1 allowing the augers and the head to be removed from the casing.

While a preferred embodiment of the invention has been described using specific terms, such description is for illustrative purposes only, and it is to be understood that changes and variations may be made without departing from the spirit or scope of the following claims.

What is claimed is:

1. A drill head assembly comprising:

a drill head body carrying a plurality of spaced bits;

a pilot bit threadably carried in a forward portion of said drill head body;

a wing cutter assembly carried by said drill head body rearwardly thereof;

an insertable connection means having interlocking surfaces for mounting said wing cutter assembly on said drill head body;

a drive shank carried by said wing cutter rearwardly thereof;

an insertable connection means having interlocking surfaces for mounting said drive shank on said wing cutter;

a longitudinal assembly screw axially disposed within and joining said drill head body, said wing cutter and said drive shank forming a drill head assembly; and an axial opening extending through said drill head body, said wing cutter assembly and into a forward portion of said drive shank for receiving said longitudinal assembly screw;

whereby the entire assembly may be readily joined and pulled together by said longitudinal axially disposed assembly screw and readily disassembled for replacement of component parts on a job site.

2. The structure set forth in claim 1 wherein said forward portion of said drive shank threadably receives an end of said longitudinal assembly screw.

* * * * *